United States Patent [19]

Schuman

[11] 3,990,069

[45] Nov. 2, 1976

[54] SYSTEM FOR MONITORING CHANGES IN THE FLUIDIC IMPEDANCE OR VOLUME OF AN ENCLOSURE

[76] Inventor: Mark Schuman, 101 G St., SW., Washington, D.C. 20024

[22] Filed: Dec. 10, 1974

[21] Appl. No.: 531,294

Related U.S. Application Data

[63] Continuation-in-part of Ser. No. 360,049, May 14, 1973, abandoned, which is a continuation-in-part of Ser. No. 213,994, Dec. 30, 1971, abandoned, which is a continuation-in-part of Ser. No. 141,171, May 7, 1971, abandoned.

[52] U.S. Cl. ..... 340/240; 109/38

[51] Int. Cl.[2] ..... G08B 21/00

[58] Field of Search ..... 340/229, 236, 239 R, 340/240, 258 R, 258 A, 258 B, 258 C, 261, 276; 137/557; 116/65; 109/31–44; 98/1.5; 73/49.2; 52/2

[56] References Cited

UNITED STATES PATENTS 3,513,463 5/1970 Stevenson, Jr. et al. ..... 340/258 R

FOREIGN PATENTS OR APPLICATIONS 656,399 8/1951 United Kingdom ..... 340/258 A

*Primary Examiner*—John W. Caldwell
*Assistant Examiner*—Daniel Myer
*Attorney, Agent, or Firm*—Wigman & Cohen

[57] ABSTRACT

A monitoring system for detecting changes in the fluidic impedance of the boundary regions or volume of an enclosure, including detecting entry into, as well as certain movements within, a substantially sealed enclosure by means of synchronous detection of a modulated pressure signal within the enclosure. The air pressure within the enclosure is modulated at a predetermined amplitude and at a frequency which is sufficiently low to substantially avoid reverberation and wave interference effects, and means tuned to that frequency produce electrical signals indicative of the amplitude and phase, whereby entry into or exit from the enclosure, opening of a chamber within the enclosure, or blockage or unblockage of passageways within the enclosure vary the amplitude and/or phase of the modulated pressure, thereby causing an electrical signal to vary sufficiently to actuate an alarm.

68 Claims, 14 Drawing Figures

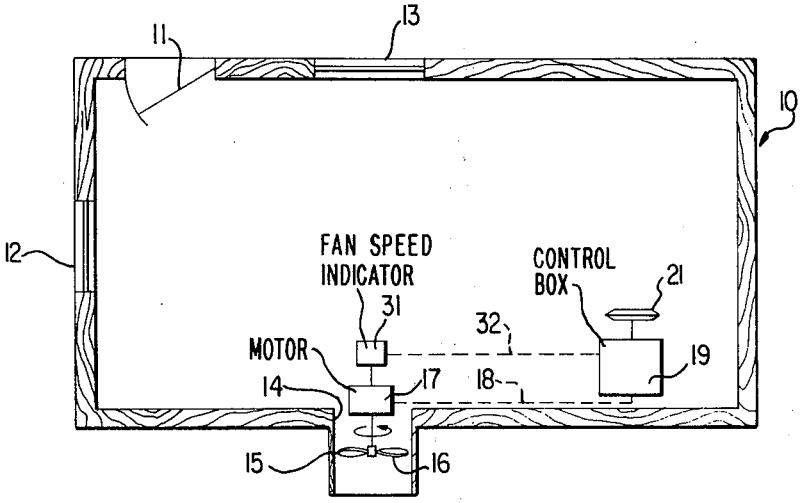
FIG. 1
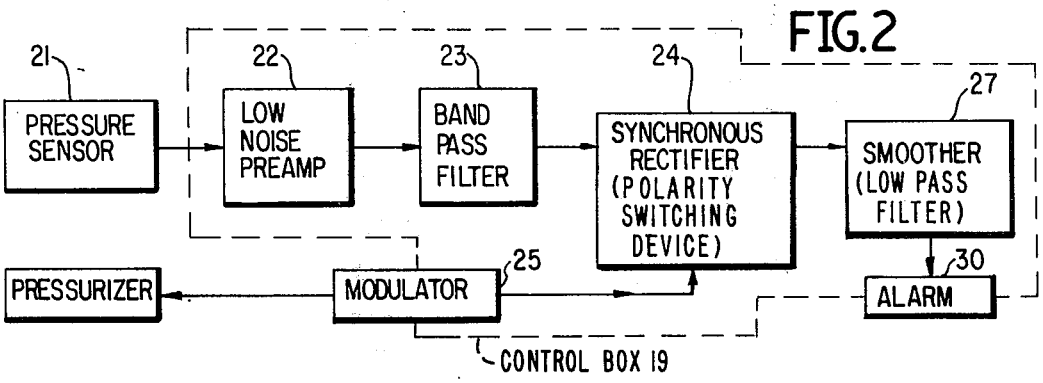
FIG. 2
FIG. 3a
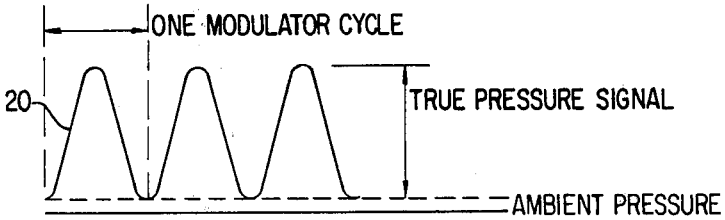
FIG. 3b
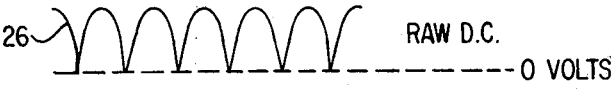
FIG. 3c
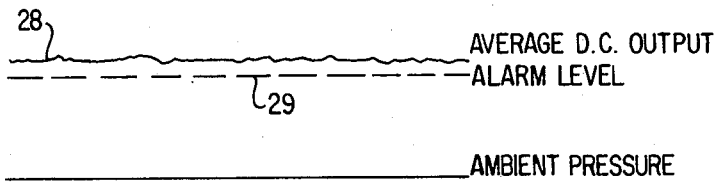
INVENTOR
MARK SCHUMAN
BY Natter, Wigman & Natter
ATTORNEYS

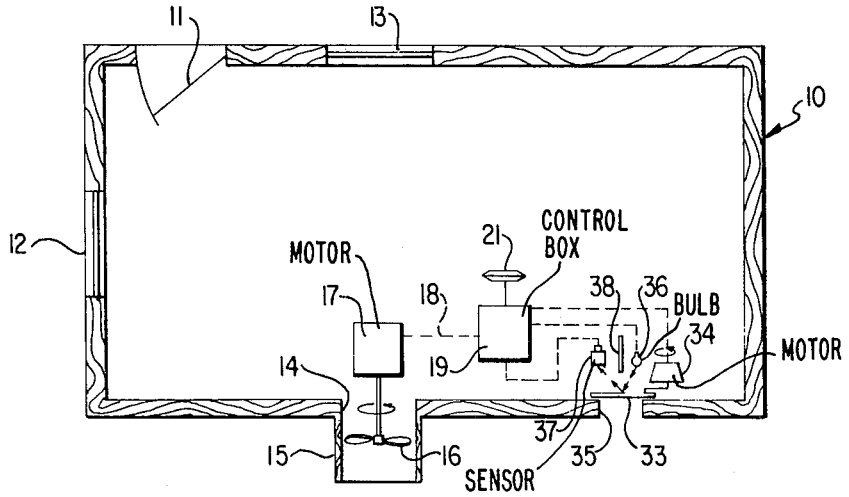
FIG.4
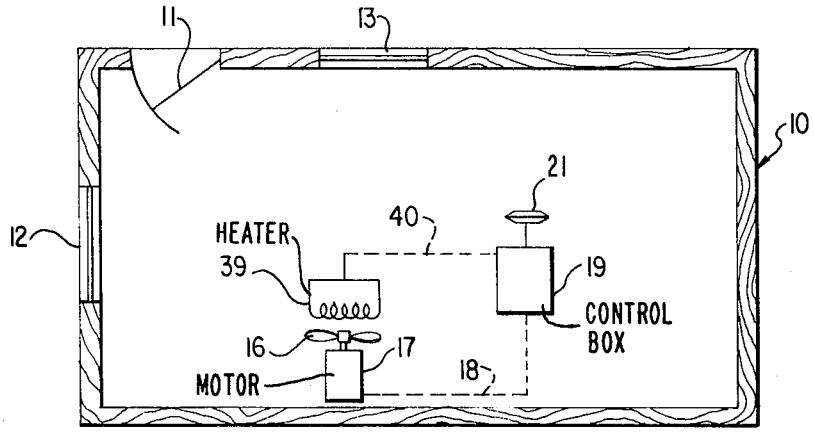
FIG.5
FIG.6
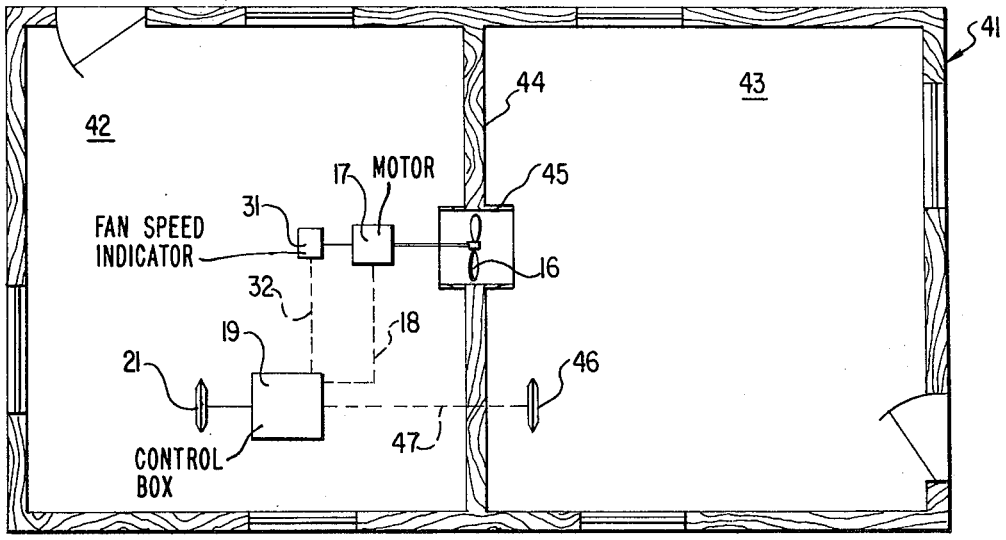

INVENTOR.

BY

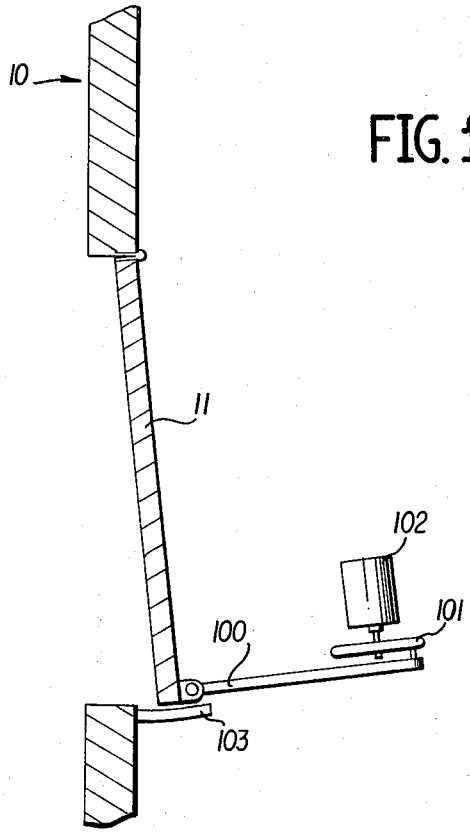
FIG. 12
FIG. 10
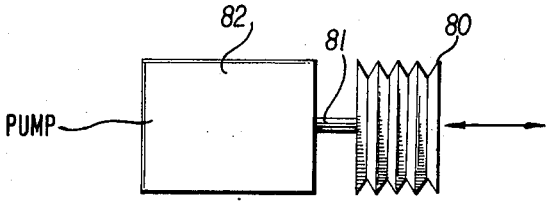
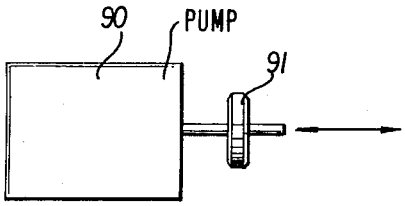
FIG. 11

SYSTEM FOR MONITORING CHANGES IN THE FLUIDIC IMPEDANCE OR VOLUME OF AN ENCLOSURE

This application is a continuation-in-part of copending application Ser. No. 360,049, filed May 14, 1973, which was a continuation-in-part of Ser. No. 213,994 filed Dec. 30, 1971, which, in turn, was a continuation-in-part of application Ser. No. 141,171, filed May 7, 1971, all three now abandoned.

This invention relates generally to the art of security systems, and more particularly to an alarm system for detecting entry into an enclosure by means of producing and monitoring a modulated pressure signal within the enclosure.

In its broadest sense, this invention relates to a monitoring system for detecting certain changes in the geometry of an enclosure such as could occur, for example, upon a break, opening, closing, stretching, compression, expansion or other movement of or addition to a boundary region of an enclosure, including movements of persons or objects within the enclosure.

In the past, the basic security or burglar alarm system consisted essentially of wiring a series of electrical contacts around the doors, windows, and other points of access to buildings or rooms therein, such that unauthorized opening thereof served to either open or close the contacts thereby actuating the alarm. Although such systems have proved relatively satisfactory, they could not detect entry into the enclosure through means other than the normal points of access which were typically wired. For example, a burglar breaking through the wall of a room, or cutting a hole in the floor or ceiling thereof would not, of course, break the contacts normally wired only around the doors and windows.

In order to overcome the shortcomings of these systems, the prior art developed various methods of securing the interior "volume" of the enclosure sought to be protected. Typical of these methods are rather elaborate and sophisticated systems utilizing sonic, ultrasonic, or standing radio waves or microwaves, as well as photoelectric and infrared means including stationary beams and scanners. The burglar or other unauthorized entrant breaks, or otherwise interferes with, the waves or beams thereby actuating the alarm. Besides generally requiring substantial apparatus and being relatively expensive to install and maintain, these systems are also not completely effective because structures and fixtures in the room or enclosure may block the waves and beams thereby producing unprotected areas. Moreover, for relatively large enclosures containing multiple rooms, such as in department stores, warehouses and homes, the systems generally are unfeasible from both an economical and technical viewpoint. In addition, false alarms due to various phenomena including heating and air conditioning systems and wind generally necessitate desensitizing the system.

The prior art also developed the concept of protecting a given enclosed "volume" by pressurizing the air therein to a predetermined point either above or below atmospheric pressure, and providing an alarm that was actuated upon the pressure varying from the predetermined point in response to an opening of some portion of the enclosure wall or boundary surface, and the air therein then communicating with the exterior. Typically, a large fan or other type air pump was installed in a wall of the enclosure and was operated to produce a constant pressure differential by blowing either in or out thereby producing either a positive pressure or a partial vacuum in the room. Conventional pressure or differential pressure sensors were used to close an electrical circuit upon the pressure differential dropping a predetermined amount, thereby actuating the alarm. The practical problems inherent in such a system, however, were great for a number of reasons.

First of all, a relatively large fan had to be used so as to effectively pressurize the enclosure in view of spurious effects as well as normal leakage therein. Unless the pressure variation necessary to actuate the alarm was sufficiently great, fluctuations in the predetermined pressurization level caused by changes in wind direction and speed, heating and cooling effects from wind, sun, furnace and air conditioning, or fan speed drift; or sensor and amplifier drift and noise, etc., would cause false alarms. Of course, the further the alarm level was set from the normal pressurization level, in order to further reduce false alarms, the less sensitive was the system and the greater the possibility that some openings of the enclosure would fail to actuate the alarm. Therefore, the pressurization level, and hence the fan capacity, had to be sufficiently large so that the variation therefrom required to actuate the alarm could be great enough to permit the normal pressurization level to fluctuate in response to the above spurious effects without actuating the alarm. The large fan capacity, of course, provided severe heating and air conditioning problems for the room or building, partly because heat is thus pumped out of the building in the winter, and into the building in the summer, thereby increasing the heating and air conditioning costs and degrading performance of the heating and cooling systems.

Good sensitivity and low false alarm rate could only be simultaneously obtained if the fan were made very large, with correspondingly large installation costs, power requirements, heat losses from the building in winter, and heat drawn into the building or enclosure in the summer.

The problem of variable external pressure caused by wind effects in such a system has been partially solved by using a reference volume or surge tank together with a restriction in the tube leading from the reference volume out of the enclosure. The tube and restriction introduce a time constant in the reference volume similar to that in the enclosure. By monitoring the pressure difference between the enclosure and the reference volume the effect of pressure variations of short duration are thereby reduced. However, the device as disclosed is most effective primarily when the principal component of the wind is directed against one wall of the enclosure. Under conditions of variable wind speed and direction and especially during storms, this system will not be effective to prevent a false alarm from wind unless perhaps additional tubes are extended through other walls of the enclosure or unless a compromise is made with the system sensitivity and/or normal degree of pressurization level, any of which changes would decrease the practicality of the system. Moreover, this system apparently cannot compensate for air pressure fluctuations caused by heating and cooling effects as a result of heaters or air conditioners going on and off, fan speed drift, or for sensor and amplifier noise and drift which may cause the differential pressure or its electrical representation to vary.

Safes and vaults are sometimes protected by a steady differential pressure system such as described above. Such a system can sometimes be foiled if a burglar places a small tent or capsule around himself and into sealing engagement with the safe, then slowly opens and widens a hole to enter through. The tent is thereby slowly pressurized without depressurizing the safe sufficiently to cause an alarm. This can be detected by the present invention if the resulting change in volume of the enclosure is sufficient.

It is, therefore, a primary object of this invention to provide a system for detecting entry into a substantially sealed enclosure.

More particularly, it is an object of this invention to provide an improved system for securing the interior volume of a substantially sealed enclosure, and to detect any entry thereto, or exit therefrom, including entry or exit through means other than normal means of access.

A further object of this invention is to provide an improved system for detecting a breaking or opening of a portion of the wall of an enclosure.

Another object of this invention is to provide an improved method for monitoring or detecting any change in the fluidic impedance of a boundary region of an enclosure.

A further object of this invention is to provide an improved method of monitoring the volume of an enclosure or the volume of a bounded region of an enclosure, and detecting a change in the volume.

Another object of this invention is to provide an improved alarm system for detecting entry into, exit from, and certain movements within a substantially sealed enclosure comprising means for pressurizing the enclosure and for detecting a variation in the pressurization upon an opening or closing of, or certain movements within, the enclosure.

Yet another object of this invention is to provide an improved system for detecting the opening or closing of a closet, room, furniture, safe, hollow wall, or other substantially closed chamber, by detecting the appearance of, or a change in, a modulated pressure within or outside of the chamber or a modulated differential pressure across a boundary region of the chamber.

Yet another object of this invention is to provide an improved pressurized system for actuating an alarm upon an unauthorized entry into, exit from, and certain movements within an enclosure, wherein the system is protected from false alarms occurring as a result of fluctuations in the pressure level caused by ambient pressure variations, random heating and cooling, and other spurious effects.

Still another object of this invention is to detect a blockage or unblockage of a passageway of an enclosure by means of a change in amplitude or phase of the modulated pressure in a chamber or bounded region of the enclosure, or by means of a change in the relative amplitudes or phases of the modulated pressures in two or more chambers or bounded regions of the enclosure.

An additional object of this invention is to detect a blockage or unblockage of a passageway of an enclosure by means of a change in the amplitude or phase of the modulated differential pressure across a boundary region of the enclosure.

A further object of this invention is to provide a system for detecting entry into a safe or other substantially sealed enclosure comprising means for modulating pressure within or outside of the enclosure at a predetermined amplitude and frequency, means for sensing the amplitude and/or phase of the modulated pressure in one or more rooms or chambers of the enclosure, and means for alarming upon a sufficient deviation from the expected amplitudes and/or phases, either on an absolute or a relative basis.

Yet still another object of this invention is to provide a system for detecting entry into or egress from a substantially sealed enclosure as well as for detecting the presence of an unauthorized body within the enclosure, comprising means for modulating pressure within the enclosure at a predetermined amplitude and frequency, means for sensing the modulated pressure within the enclosure or the differential pressure across a boundary region of the enclosure and generating at least one electrical current in response thereto, means tuned to the frequency for producing at least one signal indicative of the predetermined amplitude, and alarm means responsive to a predetermined deviation in the at least one signal as a function of a change in amplitude of the modulated pressure or differential pressure.

An additional object of this invention is to provide various practical means for modulating the pressure or differential pressure in an enclosure, including a fan, bellows, pump, door, thermally driven device, and heater or air conditioner.

Yet still another object of this invention is to provide a method for monitoring or detecting any change in the fluidic impedance of an enclosure.

Another object of this invention is to provide an improved security system for an enclosure wherein pressure is modulated and the modulated pressure is monitored by means tuned to the modulation, whereby spurious sources such as wind are substantially tuned out.

A further object of this invention is to provide an improved burglar alarm for a building or other enclosure wherein inverse pressure variations are induced on opposite sides of a boundary region of the enclosure, and wherein the modulated pressures on opposite sides of the boundary region are monitored by a tuned sensing means and are subtracted or otherwise compared such that spurious effects such as wind, which affect the pressure on both sides of the boundary region, are cancelled out to a degree by the subtraction or comparison process, while a change in the impedance or volume of a bounded region on one side of the boundary region is not cancelled out and produces a deviation in the subtracted or otherwise compared signal.

An additional object of this invention is to provide an improved security system utilizing a synchronous detection technique for sharply tuning a monitoring means to an induced pressure variation in an enclosure.

Another object of this invention is to provide an improved, flexible, substantially wireless system for protecting an enclosure and/or specified objects or chambers within or adjoining the enclosure.

A further object of this invention is to provide an improved security system for protecting specific objects or chambers within or adjoining an enclosure while permitting certain maintenance or use of the enclosure.

An additional object of this invention is to provide an improved burglar alarm which is silent and inauspicious.

Briefly, these objects may be accomplished by mounting a fan or other type blower in a port formed in a wall or other boundary region of the enclosure intended to be protected and turning the fan on and off at periodic intervals to create a cyclical pressure variation in one or more bounded regions or chambers of the enclosure. The modulated pressure in a bounded region can be monitored by a conventional sensor, such as a diaphragm type sensor or a piezoelectric crystal, and an electric current is generated. Alternatively, differential pressure across a boundary region may be sensed. The output of the sensor or transducer may first be amplified and then fed to a bandpass filter so as to amplify the modulated pressure signal at the modulation frequency, while attenuating and discriminating against spurious signals at other frequencies. The electrical bandpass can be further narrowed, i.e., the tuning made sharper, to further discriminate against spurious effects at other frequencies and phases, by feeding the signal, after any such electrical amplification and filtering, into a synchronous rectifier where it is switched in polarity twice a cycle at the proper frequency and phase, corresponding mainly to the frequency and phase of the pressure modulation, and perhaps corresponding slightly to the location of the sensor, so that a raw D.C. signal is produced having an average D.C. amplitude that is proportional to the amplitude of the modulated pressure at the given phase. This raw D.C. signal is then smoothed by means of an RC filter, thereby further narrowing the effective electrical bandwidth, and further increasing the discrimination against spurious signals, at frequencies and phases other than the modulation frequency and phase, which tend to cause false alarms. Entry into the enclosure causing a pneumatic leak sufficient to vary the synchronously rectified average D.C. signal a predetermined amount will actuate the alarm.

To measure differential pressure between two chambers of an enclosure, in order to still further cancel spurious pneumatic effects such as from gusting wind, a sensor may be located in each chamber and their difference signal, after filtering, amplification, synchronous rectification, and smoothing may be utilized to trigger the alarm as described above. The spurious effects are thereby cancelled to the extent that the two chambers are equally vented or exposed to the wind or other pneumatic noise source, i.e., to the extent that they are equally affected by the spurious source. Alternatively, the alternating pressure, or differential pressure, signal might be monitored without amplification, filtering, and/or without synchronous rectification. In addition, integration or smoothing techniques other than by means of an RC filter may be used. Also, taking the real time difference signal is only one of various means of comparison of pressures in two bounded regions. Comparison techniques also include taking the difference strictly in amplitude or phase; ratio; and difference in time derivative or slope.

Further, the pressure modulation is not necessarily sinusoidal or periodic or even cyclical. For example, the pressure modulation can be a triangular, square, or exponential wave, or a periodic pulse, or a random pulse. In any case, electronic means such as filtering may be used to tune the monitoring means to the characteristics of the induced pressure variation. Various pattern recognition techniques are known in the art for providing selective detection. As just one example, synchronous detection, e.g., synchronous rectification, can be used to sharpen the tuning and obtain greater sensitivity if desired. Such a system of synchronous rectification is disclosed in U.S. Pat. No. 2,451,572, issued Oct. 19, 1948 to H. R. Moore.

The technique of modulating and monitoring the pressure at a given frequency, by reducing the effect on the detection signal of spurious pressure effects at frequencies and phases other than that of the modulator, including spurious effects at or near D. C., typically allows the use of a much smaller fan, for a given sensitivity and false alarm rate, than do the previously used pneumatic detection techniques. The resulting decrease in fan power required, and decreased thermal loss from the enclosure, makes the modulated pneumatic techniques more feasible and practical than the "D. C." systems. In many cases, an existing heating, air conditioning, or ventilating fan can then be used.

Alternatively, instead of turning the fan on and off at periodic intervals, the cyclical pressure variation may be effected by periodically reversing the direction of the air flow thereby maintaining an average ambient pressure condition within the enclosure, thereby reducing thermal losses. The direction of air flow from the fan may be reversed by any number of means well known in the art, for example, by changing the direction or the pitch of the fan blades or by providing valving means to alternately direct the air flow into and then out of the enclosure. If the fan speed or direction of rotation is to be varied, the use of low inertia rotor and blades increases the feasible modulation frequency.

In other embodiments of the invention, the pressure may be modulated by providing a constantly operating fan either positively pressurizing or partially evacuating the enclosure, and another port in the enclosure periodically opened and closed by a rotating chopper blade or other type valve to effect the modulation. Alternatively, the pressure may be modulated by providing a heater that is periodically turned on and off to vary the pressure in the enclosure. In addition, a heater and fan can be simultaneously modulated to act as a combined pressure modulation source.

In other embodiments of the invention, the pressure may be modulated by providing a sealed bellows within the enclosure which cyclically expands and contracts, thereby periodically changing the volume of the enclosure and thus modulating the pressure therein. Similarly, a pump may be provided for cyclically withdrawing air from the enclosure and then pumping it back into the enclosure through a filter medium. The pump may be an air compressor which periodically compresses air into a chamber.

In yet another embodiment of the invention, the pressure may be modulated by oscillating a door to the enclosure by means of a motor and connecting rod from a substantially closed to a partially open position. In a sense, this embodiment is similar conceptually to the bellows in that it modulates the pressure by cyclically varying the volume of a bounded region of the enclosure.

With the above and other objects in view that may hereinafter appear, the invention will be more clearly understood by reference to the several views illustrated in the accompanying drawings, the following detailed description thereof, and the appended claimed subject matter.

IN THE DRAWINGS

FIG. 1 is a schematic view of a room protected by the alarm system of this invention, and illustrates a fan mounted in a wall of the room and electrically connected to synchronous detection apparatus;

FIG. 2 is a block diagram representative of one embodiment of a modulation, monitoring, and alarm system of this invention;

Figure 7:
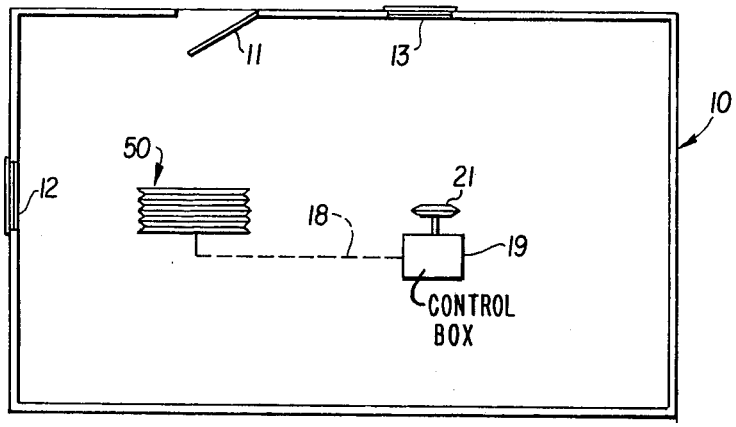
Figure 8:
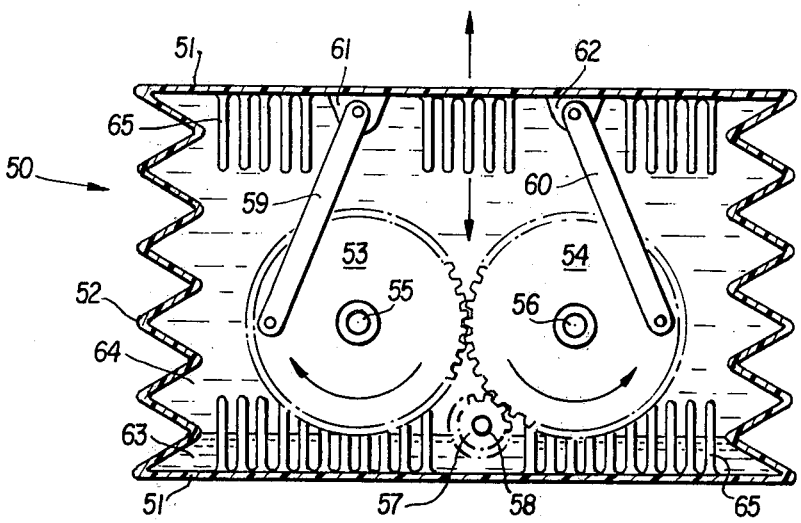
Figure 9:
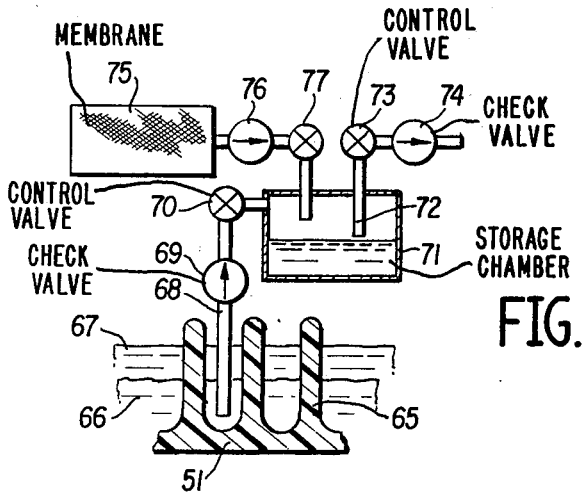

FIGS. 3*a*, 3*b* and 3*c* are graphs of the modulated pressure signal, and depict the steps in electronically switching the signal from its true A. C. state to a smoothed average D. C. output;

FIG. 4 is a schematic view of another embodiment of this invention, and depicts a rotary chopper blade mounted relative to a port in the room for modulating the pressure therein;

FIG. 5 is a schematic view of another embodiment of the alarm system, and depicts a heating element adapted to be turned on and off for effecting the pressure modulation;

FIG. 6 is a schematic view of a modification of the embodiment of the invention illustrated in FIG. 1, and depicts a fan mounted in a wall between two rooms in a building and adapted to be turned on and off or periodically reversed to effect a pressure modulation in each room, the modulated pressure in one room being 180° out of phase with the modulated pressure in the other room;

FIG. 7 is a schematic view of still another embodiment of the invention, and depicts a closed bellows containing a liquid and vapor and adapted to be alternately contracted and expanded for varying the volume of the enclosure and thus modulating the pressure therein;

FIG. 8 is a vertical sectional view of the bellows of FIG. 7, and depicts the motor driven meshed counter-rotating gear wheels which operate to cyclically expand and contract the bellows;

FIG. 9 is a fragmentary schematic view of a control system for controlling the internal pressure within the bellows of FIGS. 7 and 8;

FIG. 10 is a schematic view of an oscillating bellows connected to a pump, which may be a thermally driven pump, such as a regenerative gas cycle pump;

FIG. 11 is a schematic view of another embodiment of the invention, and depicts a thermally driven pump adapted to pump air into and out of the enclosure; and FIG. 12 is a fragmentary section view of yet still another embodiment of the invention and depicts a door of the enclosure adapted to be oscillated by means of a motor, crank, and connecting rod from a substantially closed to a partially open position for effecting the pressure modulation.

Referring now to the drawings in detail, there is illustrated in FIG. 1 a substantially closed structure or enclosure designated by the numeral 10. The enclosure 10 may be a unitary building such as a warehouse, a room or other subdivision within a building, or any other type enclosure such as a vault, showcase, etc. As illustrated, the enclosure 10 includes a door 11, windows 12, 13, and a port 14 having a duct 15 extending outwardly therefrom and communicating with the exterior of the enclosure 10.

The enclosure 10 should be substantially sealed, but need not be completely airtight or hermetically sealed. In general, normal leakage around the door 11, windows 12, 13, through ordinary cracks and crevices, and even through a vent or duct, can be tolerated, although it is preferable to minimize to a reasonable extent such leakage.

A fan or other type blower 16 having an electric motor 17 is suitably mounted in the duct 15 and electrically connected (as indicated by the dotted lines 18) to a control box 19 situated within the enclosure 10. With the door 11 and windows 12, 13 closed, suitable modulator means (not shown) in the control box 19 are adapted to turn the fan 16 on and off at periodic intervals thereby creating a predetermined cyclical pressure variation within the enclosure 10 which is represented by the curve 20 in FIG. 3*a*. When the fan 16 is turned on, air is drawn into the enclosure 10 through the port 14 thereby increasing the pressure within the enclosure 10; and when the fan 16 is turned off, air quickly leaks out of the enclosure 10 through the normal leaks therein and through the duct 15 and the pressure is thereby decreased.

A conventional pressure sensor 21, such as a piezoelectric, piezoresistive, or capacitive type transducer, or the like, is connected to the control box 19 and monitors the modulated pressure within the enclosure 10. As illustrated schematically in FIG. 2, the output from the pressure sensor 21 may be fed to a low noise preamplifier 22 to increase the signal voltage. The output from the preamplifier 22 may be supplied first to a bandpass filter 23 which passes the modulated frequency but attenuates spurious signals at other frequencies, and then to a synchronous rectifier 24 where it is switched in polarity twice every cycle at the proper frequency and phase corresponding to the frequency and phase at which the pressure in the enclosure 10 is modulated. This is accomplished by feeding a signal corresponding to the operation of a modulator 25 (which in this case is the means for turning the fan 16 on and off) to the synchronous rectifier 24 as a reference. The representation of the signal after rectification is illustrated by the curve 26 in FIG. 3*b* and may be characterized as raw D.C. This signal is then fed to a smoother 27, which is a low pass filter such as an RC filter, where the signal is smoothed out so as to represent the average D.C. output proportional to the amplitude of the modulated pressure, as illustrated by the curve 28 in FIG. 3*c*. Alternatively, other integration and smoothing techniques may be used. When the signal 28 drops below a predetermined level, as designated by the dashed line 29 in FIG. 3*c*, which would occur upon the amplitude of the A.C. signal 20 decreasing as a result of the enclosure 10 being opened, an alarm 30 is actuated. For this purpose a comparison circuit, with an adjustable level, may be provided in alarm 30 to actuate the alarm.

Thus the monitoring system is first tuned by bandpass filter 23 to the approximate pressure modulation frequency. Then the synchronous rectification and smoothing sharpens the tuning by further narrowing the frequency passband and centering the passband at the modulation frequency. This increases the attenuation of spurious signals not at the modulation frequency. In addition, since the rectification is synchronized both to the modulation frequency and phase, the synchronous rectification and smoothing not only sharpens the "frequency tuning" afforded by bandpass filter 23, but also tunes the system to the modulation phase as well. An additional amplifier, not shown, may be added between filter 23 and rectifier 24, or may be combined with bandpass filter 23. Such an amplifier would further strengthen the signal relative to certain electronic noise such as switching noise, power supply pickup, or RF pickup. Bandpass filter 23, by attenuating much of the noise and spurious signals fed from preamplifier 22, precludes saturation of the electronics following preamplifier 22, including any such second amplifier. Filter 23 also filters out any odd-order higher harmonics which otherwise would, to some extent, pass through rectifier 24 and smoother 27 to possibly cause a false alarm.

In effect, therefore, the circuit is tuned to the modulating frequency and phase, and spurious effects such as variations in the ambient pressure, or temperature and pressure changes caused by heating or air conditioning apparatus going on and off, and some random effects in the monitoring system itself, which do not have significant frequency components corresponding to the modulating frequency of the system, produce essentially no D.C. output and thus cannot vary the signal 28 to cause a false alarm. As to those components of the spurious effects which do have frequency components at or almost at the switching frequency of the system, these components are integrated out to a lesser extent, depending on their frequencies and phases, by means of the RC filter of the smoother 27. In theory, if the RC time constant is made infinite, the signal and noise bandwidth become infinitessimal and the signal can be completely smoothed out, thereby eliminating all spurious effects not precisely at the modulating frequency. However, as a practical matter, increasing the integration time also increases the time to alarm from the initial sensing of an opening to the enclosure, and also decreases the sensitivity to short term effects such as would occur were the enclosure opened and then quickly closed. In practice, therefore, a compromise should be made by choosing an integration time which is sufficient to permit the alarm level 29 to be relatively close to the output signal level 28 without permitting the jiggle in the output signal to cause a false alarm, while at the same time not so long as to render the system too insensitive to short term effects or to require an unacceptable time to alarm.

One specific form of switching arrangement suitable for performing the synchronous rectification and smoothing is shown in the aforementioned U.S. Pat. No. 2,451,572. In this patent, radiant energy rather than pneumatic pressure is being modulated and, after passing through a sample container, the modulated radiance is monitored using synchronous rectification and smoothing, whereby information about the sample is obtained. Thus, in this patent, radiant energy from source 21 is varied in intensity by means of a modulator 1–3. After passing through a sample container, and optical filtering, the modulated radiance is detected by the sensor 29. The sensor produces an electrical signal which is amplified and filtered by elements 30–36 and then switched in polarity twice a cycle by synchronous rectifier 4–11 and 14–21' which is driven by shaft 2 of the modulator, whereby the rectification is synchronized with the modulator and with the frequency and phase of the modulated radiance, whereby the rectification is maximized for the frequency and phase of the modulated radiance. The rectified signal is fed to meter 50 via smoothing capacitor 51. Capacitor 51, in conjunction with the resistance of meter 50, acts as a smoother or low pass filter. Because of the synchronous rectification and electronic filtering, the meter 50 is tuned to the frequency and phase of the modulated radiance, whereby the monitoring system discriminates against spurious signals at other frequencies or phases.

It should be apparent to those skilled in the art that the synchronous rectifier 24 of the present invention (see FIG. 2) could have the same configuration as the above-mentioned synchronous rectifier of the aforementioned patent; that the synchronous rectifier 24 could be driven by the modulator 25 in the same fashion as in the aforementioned patent; and that the amplified signal from bandpass filter 23 could be synchronously switched and rectified in synchronous rectifier 24 and applied to alarm 30 (the DC recording meter 50 of the aformentioned patent) via smoother 27 (capacitor 51 of the aforementioned patent). It should be stressed that the particular design, per se, of the synchronous rectifier forms no part of the present invention. In fact, all of the electric "boxes" of the present invention may use conventional electronic circuitry to accomplish the functions and purposes of the boxes disclosed herein.

It should be understood that in addition to spurious effects caused by ambient pressure variations and temperature changes being to a great extent integrated out by this tuned system, the spurious effects caused by detector and amplifier noise may also be to an extent integrated out. However, the effect of drift in the speed of fan 16 must be handled in another manner, since this effect is primarily at the modulation frequency.

As seen in FIG. 1, there may be provided a fan speed indicator 31 which is electrically connected to the control box 19 as indicated by the dotted line 32. The speed indicator 31 may be a generator mechanically connected to the fan motor 17, an electronic sensor, a wind speed indicator or any other conventional means for sensing the speed or pressurizing effect of the fan 16 and generating an electric current in response thereto. In any event, if it is found necessary or desirable to compensate for drift in the speed of the fan 16, instead of having the output signal responsive only to the pressure detected by the sensor 21, the final output signal could be made the ratio of the smoothed output voltage 28 to a fan speed voltage generated by the fan speed indicator 31. The final output signal would thus be essentially corrected for fan performance.

In a modification of the system illustrated in FIG. 1, the fan 16 could be utilized in combination with the normal heating or air conditioning apparatus of the building. The fan 16 would be disposed in the air ducts and operated independently of the furnace or other air conditioning equipment going on and off. In effect, the temperature gradient caused by the heat from a furnace, for example, would, if located downstream of the fan, amplify the output generated by the fan 16 and thus produce a pressure signal of increased amplitude. However, this would raise the D.C. voltage 28 and move it further away from the alarm level 29, thereby decreasing the sensitivity of the system to an opening in the enclosure. Correspondingly, a cooling effect caused by air conditioning coils downstream of the fan would decrease the D.C. voltage 28 thereby tending to cause a false alarm. Such effects in effective fan performance, or in fan speed itself, could be compensated for by utilization of a secondary pressure or air speed sensor (not shown), typically just downstream of the fan and any such heater or air conditioner elements, to monitor the combined output of both the fan 16 and the amplifying and attenuating effects of the furnace or air conditioner, and thereby correcting for all the drift (either in fan speed or temperature) by utilizing the ratio of the voltage produced by the primary pressure sensor 21 to a voltage produced by the secondary pressure sensor as the final output signal 28. A secondary pressure or air speed sensor of this type would, in general, obviate the need for the fan speed indicator 31.

While the system has been specifically described herein as having the alarm 30 actuated when the amplitude of the A.C. pressure signal 20 decreases as a result of the enclosure 10 being opened, it should be understood that it is theoretically possible to sense an opening of the enclosure 10 by means of a change in the phase of the signal 20. Moreover, if an intruder or otherwise unauthorized entrant is so situated within the enclosure 10 relative to the pressurizer (e.g., fan 16) and the sensor 21 as to interfere with the air flow induced by the pressurizer, as by blocking, unblocking, or causing an air flow passageway in the enclosure, any resulting phase change or lag may also be theoretically sensed as a change in amplitude of signal 20 to actuate the alarm 30. In this manner, the system may be designed not only to sense an actual opening of the enclosure 10, but also to sense the presence of an unexpected body therein. However, while the detection of a change in phase of the signal 20, by monitoring its amplitude at the phase illustrated in FIG. 3*b* is possible, the relatively large amplitude of the signal 20 renders it difficult as a practical matter to sense small changes in this amplitude that would result from a change in phase. It is, therefore, contemplated within the scope of this invention to provide a second synchronous rectifier set to switch at 90° from the switching phase of the first synchronous rectifier 24, as well as a second smoother and an alarm which is activated when the rectified voltage varies in response to a phase change of the modulating pressure signal, a Doppler effect from a moving body, or from some other cause. Because the second synchronous rectifier will switch at 90° from the switching phase of the first synchronous rectifier 24, the rectified voltage should be zero and thus any deviation therefrom resulting from a phase change of the modulating pressure signal may be readily sensed and caused to trigger an alarm, or may be compared relative to the rectified voltage produced by the first synchronous rectifier 24, as by a ratio method, to thereby cause an alarm.

The concept of intruder detection by means of phase change sensing is particularly effective where the substantially closed structure or enclosure to be protected is a building or portion thereof having a plurality of rooms or subdivisions joined by connecting passageways. While a single pressure modulating means might be used to pressurize the entire system, pressure sensors could be situated in several locations, although it is theoretically possible to use only one sensor 21 as in the enclosure 10. In this type of branch system, the presence of an intruder or other unexpected body in one of the connecting passageways (such as a doorway or narrow corridor) would cause a partial blockage that may be detected as a change in phase, as well as amplitude, of the modulated pressure in one or more rooms, e.g., the pressure signal in a room blocked off from the modulator would be of lesser amplitude and lagging phase, while the pressure in a room on the modulator side of the blockage might slightly increase in amplitude and advance in phase. Thus, differences in amplitude or phase of the modulated pressures in two or more chambers may be monitored to detect changes in the fluidic impedance or geometry of the enclosure.

Furthermore, by proper placement of even a single sensor, an intruder opening or closing a chamber to pressurization, e.g., a hollow ceiling, double wall, attic, drawer, safe, or room may be detected by the relatively large increase in signal or the appearance of a large change in pressure in the chamber. Because of the large signal when, for example, a normally closed chamber is opened to pressurization, a sensor unit located in the chamber and tuned to the waveshape or characteristic frequencies of the modulator generally would not need synchronous rectification and could be portable, battery operated, and would not necessarily have to be wired to the pressure modulator, and could generate and transmit a pressure variation or pressure deviation indicating signal or an alarm signal. Thus the monitoring means may include, or even consist of, one or more remote, portable sensor-transmitter units which may be part of a partially or completely wireless system. The alarm or indicating signal could be transmitted into the air and/or to a central unit or station, by conventional means for transmitting signals, e.g., pneumatic waves such as sound; electromagnetic radiation such as radio waves; or electric current in wires. For transmitting radio type waves, a transmitting coil or dipole or other antenna could be used. For transmitting the alarm by pneumatic waves, an electric coil driven diaphragm or a piezoelectric transmitter might be used.

For transmitting a pressure variation indicating signal, such a transmitter could be responsive, for example, to the output of bandpass filter 23 in FIG. 2, or, if synchronous rectification were used, alternatively to the output of smoother 27. For transmitting a pressure deviation indicating signal, such a transmitter could be responsive to the output of the comparator circuit provided in alarm unit 30.

It should be understood that, in general, the modulated pressure of the present invention is preferably at subsonic frequencies low enough to substantially eliminate traveling wave interference phenomena, such as resonance and standing waves, resulting from reflection of the traveling waves by the walls of the enclosure. This is because the pneumatic wave interference patterns are modified in amplitude, phase, position, and wavelength by changes in the speed, and therefore wavelength, of the pneumatic waves as a result of changes in air or gas temperature and velocity, which may in turn be caused by such transient factors as heating or air conditioning systems, wind, outdoor temperature changes, and solar loading. Resulting changes in the speed and wavelength of the pneumatic traveling waves affect constructive and destructive interference of the waves upon reflection by the walls of the enclosure, and thus affect the pressure amplitude and phase monitored by a given pressure transducer. To minimize or avoid resulting system drifts and false alarms, the pressure variation should be introduced or generated by the pressure modulator at a frequency low enough to minimize or avoid such reverberation effects, whereby, at any given instant in time, the induced pressure is substantially uniform in any given chamber of the enclosure. On the other hand, other problems appear and increase as the modulation frequency is lowered. For example, as the modulation frequency is decreased, the complexity of the electronics and sensor unit generally increases for a given sensitivity. Also, the phase lag effect described above becomes smaller and the technique may thus become more difficult at a very low frequency. In addition, the technique of averaging or intergrating over one or more cycles generally becomes more difficult at very low frequencies. Furthermore, a quick opening and closing of a door or other short-lived temporary movement of a boundary region of an enclosure is generally more difficult to detect at a very low frequency. Thus, too low a frequency is to be avoided as well as too high a frequency, and a compromise frequency must be selected to avoid or minimize both high and low frequency problems. In addition, other factors must be considered in choosing the compromise frequency of modulation, such as characteristics of the modulator, as well as the frequency spectrum of any spurious source, such as the wind. Generally, frequencies of modulation in or near the range of 0.1 to 10 Hertz are contemplated for protecting from one up to a few ordinary sized rooms. In the case of a complex or other non-sinusoidal pressure variation induced by the pressure modulator, the term "frequency of modulation," or its equivalent, as used herein generally refers to a frequency component or frequency band to which the sensing or monitoring means is tuned in order to monitor the deviation from the predetermined pressure variation. This frequency component or band generally is also the principal or characteristic frequency of the modulated pressure. In the case of a periodic pressure modulation, a phrase such as "the frequency (of modulation)" generally refers to the fundamental frequency component of the pressure modulation, which generally is the predominant frequency component. However, a modulated pressure, whether periodic or not, may have more than one principal or characteristic frequency so that the above phrase may in certain cases refer to such a principle or characteristic frequency other than the fundamental, such as where sophisticated pattern recognition is required or desirable and the monitoring system includes means for monitoring or tuning to one or more of these principal or characteristic frequencies. In addition, since even a so-called "periodic" pressure modulator has some frequency drift, and since even a sharply tuned monitoring means has a finite frequency bandwidth, the term "frequency", as used herein, generally refers in practice to a finite band of frequencies, or to the center frequency of such a band, wherein the band or center frequency may drift or otherwise change with time.

Another embodiment of the invention is illustrated in FIG. 4. In this embodiment the fan 16 is driven continuously and a chopper blade 33 is rotated by an electric motor 34 to periodically open and close a port 35 formed in a wall of the enclosure 10 to produce a modulating pressure therein. In order to provide a reference for the synchronous rectification of the pressure signal detected by the sensor 21, a small bulb 36 may be provided to emit light which periodically reflects off the chopper blade 33 at the proper frequency and phase, to a sensor 37, such as a photodiode or the like, which generates a current that is conducted to the synchronous rectifier 24 in the control box 19. A shield 38 is provided to prevent the light from the bulb 36 from being transmitted directly to the sensor 37.

In the embodiment illustrated in FIG. 5, the fan 16 again is operated continuously, but this time merely serves to amplify the effects of a heater 39, electrically connected to the control box 19 as indicated by the dotted lines 40, which is turned on and off periodically by the modulator 25 to provide the pressure modulation within the enclosure 10.

A modification of the embodiment of the invention illustrated in FIG. 1 is illustrated in FIG. 6 wherein there is shown a substantially closed or sealed structure or building 41 having two rooms or chambers 42, 43 therein separated by a common dividing wall 44. A duct 45 extends through the interior wall 44 and communicates with each of the rooms 42 and 43. The fan 16 is mounted in the duct 45 and is modulated as in the system of FIG. 1. The effects in room 42, therefore, are substantially identical to those in the enclosure 10 of FIG. 1. In this embodiment, however, room 43 is also protected by means of an additional pressure sensor 46 disposed therein and electrically connected to the control box 19 as indicated by the dotted lines 47. It should be apparent, therefore, that the fan 16 produces a modulating pressure in one of the rooms 42, 43, which is one-half cycle out of phase with the modulating pressure in the other room, i.e., is inverse with respect to the modulating pressure in the other room.

Instead of turning the fan 16 on and off periodically, the air stream could be cyclically blocked by means such as a motor driven rotating vane or vanes. Or the pressure in rooms 42 and 43 may be modulated by periodically reversing the direction of fan 16. In this last manner, the pressure in both rooms 42 and 43 should oscillate above and below atmospheric pressure with the average pressure being atmospheric in each room. This scheme should obviate any complaints about the pressure modulation adversely affecting the heating or air conditioning characteristics in the building 41.

If the differential pressure across boundary region or wall 44 is monitored, the effects of external wind on bounded regions or rooms 42 and 43 tend to cancel when the outputs of sensors 21 and 46 are subtracted in control box 19. To maximize the cancelling, the pneumatic time constants of rooms 42 and 43 should be equal. Thus, if their volumes are equal, so should their fluidic impedance or leakages to the outside be substantially equal. If their volumes differ by a given ratio, so should their fluidic impedances or leakages to the outside differ by approximately the same ratio if their pneumatic time constants relating to wind effects are to be approximately equal. This would tend to equalize the very slight wind effects in the two rooms, whereby the wind effects would be cancelled by the subtraction process, to allow greater detection sensitivity without false alarms. Since wind is directional, and since rooms 42 and 43 have different exposures, the cancelling process will be less effective for some wind directions than for others. If rooms 42 and 43 have vents, such as for fresh air, exhaust, heating, or air conditioning, it is therefore generally preferable not only that the fluidic impedances or conductances of the vents be designed or adjusted for similar pneumatic time constants and susceptibility of the two rooms to effects from spurious sources such as wind, heaters, or air conditioners that may have significant frequency components at or near the modulation frequency, but further that the vents or ducts combine with each other and/or lead to the outside at the same or proximate locations on the structure or enclosure, whereby the effects of wind direction become relatively insignificant.

In essence, each of rooms 42 and 43 is acting as a reference chamber for monitoring or determining the wind effects in the other room and correcting the modulated pressure reading in the other room for the wind effects, so as to correct for, or cancel out, the wind effects. Such a reference room or chamber may be useful in other similar ways or for other system configuration also.

The pressure readings made by sensors 21 and 46 may be subtracted either before or after some stage of the signal processing, e.g., after some amplification. Or, a single, differential pressure, sensor, such as a flowmeter, may be used to directly monitor the differential pressure across boundary region or common wall 44. Alternatively, instead of comparing absolute pressures in bounded regions 42, 43, as by the subtraction process described above, the pressure variations themselves may be compared in amplitude and/or phase in box 19 at some stage of the signal processing. Difference, linear combination, and ratio are three examples of comparison. For example, the pressure variation in each of rooms 42, 43 may be fed to a separate preamplifier and bandpass filter such as preamplifier 22 and filter 23 of FIG. 2. If linear combination is desired, the separate preamplifiers may have different gains, e.g., to modify the relative sensitivities of the two readings or to more completely cancel a spurious signal. Then the two amplified and filtered AC signals representing the variations in pressure in rooms 42 and 43 may be subtracted by conventional means, such as a differential amplifier, and the amplified difference signal then fed to synchronous rectifier 24 for further processing in the usual way. Or, the two amplified and filtered signals may be compared in another way, such as ratio, average, or strictly phase difference.

For some of the very low pressure modulation frequencies contemplated for this invention, some special electronic techniques, such as using a high frequency carrier, may be necessary to obtain the proper signal processing of the very low frequency signals.

The reversal of the fan 16 may be accomplished by any means well known to those skilled in the art; for example, periodically changing the pitch of the blades of the fan 16, or by providing appropriate valving, ducts, and port means whereby the flow of air may be cyclically directed from one of the rooms 42, 43 into the other, and then vice versa. It should be understood that the means described above in connection with FIG. 6 for modulating the air flow from fan 16 also may be used to modulate fan 16 in connection with the embodiments of the previously described Figures.

Another embodiment of the invention is schematically illustrated in FIG. 7 wherein a closed bellows 50 is provided which cyclically expands and contracts, thereby periodically changing the volume of the enclosure 10 and thus modulating the pressure therein. As in the previously described embodiments of the invention, a reference signal corresponding to the periodic operation of the bellows 50 is fed to the synchronous rectifier 24 so that it may be switched in polarity twice every cycle at the frequency and phase at which the pressure in the enclosure 10 is modulated.

As seen in FIG. 8, the bellows 50 consists of end plates 51 connected by accordion-like folds 52 which permit the bellows 50 to expand and contract. A pair of meshed counterrotating gear wheels 53, 54 are mounted on support shafts 55, 56, respectively, within the bellows 50. The gear wheels 53, 54 are driven by a pinion 57 mounted on the end of a drive shaft 58 of a motor (not shown). The gear wheels 53, 54 are joined by means of connecting rods 59, 60, respectively, to flanges 61, 62 which depend from the upper portion of the frame 51. It should be apparent, therefore, that with the bellows 50 supported on a horizontal surface, the gear wheels 53, 54 will be rotated in opposite directions by means of the motor-driven pinion 57 and thus the bellows 50 will cyclically expand and contract vertically under the force of the connecting rods 59, 60.

In order to reduce the load on the motor (not shown) and also the mechanical stresses on the bellows 50, the bellows 50 may contain a fluid having a vapor pressure on the order of an atmosphere at ambient temperature, in sufficient quantity to produce a liquid layer 63 and a vapor phase 64 above it. Internal heat transfer fins 65, formed as part of the frame 51, serve to transfer heat to and from the fluid as the fluid evaporates and condenses during the expansion and contraction cycle of the bellows 50. To the extent that the fluid temperature can be kept constant by the heat transfer technique resulting from the thermal storage properties of the fins 65, so can the fluid pressure within the bellows 50 be kept constant, thereby reducing the work load on the motor, and the power required. The moving parts, and possibly a motor driven fan (not shown), increase the cyclical heat transfer by inducing circulation of the vapor and liquid. The fluid may also be useful for lubricating the mechanism.

The vapor pressure within the bellows 50 will, in general, increase with increasing temperature. If desired, this pressure can be controlled in order to decrease the load on the mechanism and motor. One method for reducing the undesirable increase in internal pressure with temperature within the interior of the bellows 50 is illustrated in FIG. 9. At least two fluids 66, 67 having different specific gravities are provided within the interior of the bellows 50. One of the fluids may be collected by means of a tube 68 which leads through a check valve 69 and then through a control valve 70 to a storage chamber 71. The control valve 70 may be either pressure or temperature sensitive and adapted to open when the pressure or temperature within the bellows 50 increases to a given value, thereby partially removing one of the fluids from the system by admitting a portion of it into the storage chamber 71. Another tube 72 leads from the storage chamber 71, through a second control valve 73 and another check valve 74 back to the interior of the bellows 50. The second control valve 73 is adapted to open when either the pressure or temperature within the bellows 50 decreases to a given lower value, thereby readmitting the fluid to the system and increasing the pressure thereof. Thus, one of the fluids is stored when the pressure is high and released whenever it is low. Unfortunately, the vapor phase of this fluid cannot be removed in this manner.

The alternative control system of FIG. 9 may include a semi-permeable membrane 75 through which the selected control fluid may be withdrawn in vapor phase from the interior of the bellows 50 and admitted to the storage chamber 71 through a check valve 76 and a pressure or temperature-sensitive control valve 77. By means of this modification, the partial pressure of the selected control fluid within the bellows 50 may be reduced substantially below its vapor pressure, perhaps almost to zero. More than one vapor can be controlled in this manner.

Still another alternative is to thermally insulate bellows 50, and to heat a fluid within the bellows 50 and thermostat it at a constant temperature to obtain a constant, e.g., atmospheric, pressure independent of changes in ambient temperature.

It should be understood that the various above-described techniques for controlling the temperature within the bellows 50 are necessary because of the high power otherwise required to compress the bellows 50 due to the great pressure developed within the confined interior thereof. Therefore, although the bellows 50 has been specifically described herein as consisting of a limited interior volume, it is contemplated within the scope of the invention to connect the interior of the bellows 50, either directly, or by means of a pipe, to a drain, flue, or any type of large volume reservoir, including the outside atmosphere, thereby reducing the backpressure within the bellows 50.

Although the pressure-modulating bellows 50 of FIGS. 7–9 has been specifically described as having an electric-motorpowered drive, it is contemplated within the scope of the invention that other bellows motive means may be provided. For example, as illustrated schematically in FIG. 10, a sealed bellows 80 may be connected by means of a pipe 81 to a thermally driven pump 82 operated sealed. The pump 82 may be a regenerative gas cycle pump operating on a fuel such as propane, the compression and expansion of the gas therein serving to alternately expand and contract the bellows 80, thereby serving to modulate the pressure within the enclosure in which the bellows 80 is located. Because of the greater specific energy content of fuel than of batteries, a thermally operated pump has an advantage in case of power failure.

Another related embodiment of the invention is illustrated schematically in FIG. 11 wherein there is provided a thermally-driven pump 90 adapted to pump air into and out of the enclosure in which it is located through a filter 91. It is to be understood that while the bellows 50 of FIGS. 7–9 and the bellows 80 of FIG. 10 are closed systems that modulate the pressure of the enclosures in which they are located by varying the volume thereof, the pump 90 of FIG. 11 is an open system that alternately withdraws air from the enclosure, and then pumps it back into the enclosure. Pump 90 may, of course, be electrically driven. An example of a thermally driven pump 90 is illustrated in FIG. 1 of my U.S. Pat. No. 3,782,859, issued Jan. 1, 1974. The oscillating piston causes an alternate heating and cooling of the gas and therefore a cyclical pressure variation in the pump and an oscillating gas flow between the pump and a load 25 via conduit 26 of the above-mentioned patent. A variation of this thermally driven pump is disclosed in my U.S. Pat. No. 3,767,325, issued Oct. 23, 1973.

Another embodiment of the invention is illustrated in FIG. 12 wherein the pressure modulating means is the door 11 of the enclosure 10. The door 11 may be oscillated from a substantially closed to a slightly open position through a throw of several degrees by means of a connecting rod 100 and a crank 101 driven by a small motor 102. Sealing strips 103 may be provided along the side and top of the door 11 to reduce leakage. To avoid any possible injury to an occupant or pet coming in contact with the oscillating door, the device can be made to stall or slip under a load exceeding a given value.

It should be understood that while the pressure sensor 21 has been specifically disclosed herein as being a piezoelectric crystal or the like, it is contemplated that other type sensors could be used. For example, a flowmeter could be installed in a wall of the enclosure and adapted to generate an electric current as a function of the airflow, and thus the differential pressure across the wall. A flowmeter is one example of a single sensor which can monitor differential pressure across a boundary region.

Inasmuch as the speed of the fan 16, or its phase lag in the event that the motor 17 is of the synchronous type, is affected by the pneumatic leakage in the enclosure and thus the load on the fan, means such as the fan speed (or phase lag or air flow) indicator 31 itself could be used to detect an intruder by, in essence, monitoring the load on the fan. This would probably be a less costly, but also less sensitive, version of this detection technique.

In view of the foregoing, it should be readily apparent that there is provided in accordance with this invention a novel system for detecting entry into an enclosure. The utilization of the concept of synchronous detection of a modulating pressure signal can effectively reduce the required size of the pressurization fan by an order of magnitude relative to the fans used in pressurized detection systems of the prior art. Because the spurious effects caused by ambient pressure variations, wind changes, automobiles passing by, heaters and air conditioners going on and off, the sun coming in and out, detector and amplifier noise, etc., are almost entirely filtered or integrated out, the alarm level may be set relatively close to the output signal level without the danger of having false alarms, so that the change in signal required to trigger an alarm is very small. The system can thus be highly sensitive while the capacity of the fan or other type of modulator need not be so great as to cause heating or air conditioning problems within the enclosure. Even without synchronous rectification, the technique of using low frequency pressure modulation reduces the required differential pressure for a given sensitivity, and can protect a large, multi-chambered structure or enclosure with only a single pressure modulator. It should be apparent, therefore, that the detection and alarm system of this invention will be both more reliable and less expensive than those of the prior art.

It should be further understood that if pressure is monitored at two phases 90° apart, as described, a deviation in signal too small to cause an alarm in either channel may, if occurring simultaneously in both channels, be caused to trigger an alarm, for greater sensitivity. Also, since a break in an enclosure connects the enclosure to a new volume, the alarm technique disclosed herein may be interpreted as a means for monitoring volume and detecting a change in volume. In addition, more than one frequency can be used, including frequencies at which a portion of an enclosure resonates. Also, a scan of frequencies can be made. Further, to detect the quick opening and closing of a door of an enclosure, or other unusual pressure disturbance, a pressure sensor utilized in the synchronous rectification network may also be used to trigger an alarm upon the occurrence of a large, rapid, or other type of unusual pressure change. Also, to avoid customizing, a fan may be mounted in a portable partition which is placed in a doorway, hallway, or stairwell when the alarm system is to be operated. To partially seal off a room desired not to be monitored, such a partition without the fan could also be used. In this case, the partition might contain small holes or slits to allow some air and sound to pass through it in order to provide an occupant in the unmonitored room with sensual information, such as smell and sound, as to status and well-being of the monitored portion of the enclosure. Further, a chamber of a piece of furniture might be used to contain and conceal part or all of an alarm system, e.g., a sensor unit, sensor-transmitter unit, or a bellows. Also, various other variable volume devices may be used to vary the volume of a bounded region, such as a piston and cylinder or a Bellofram device (pistonlike device utilizing a leak-tight, flexible, rolling seal).

It should also be understood that it is contemplated within the scope of this invention to monitor any type of a change in the geometry of an enclosure, including changes in volume, such as would occur, for example, upon deformation of a boundary region or any other relative change between boundary regions, including movement of objects or persons within the enclosure, as well as changes in volume occurring upon an actual break in an enclosure.

The term "boundary region" as used herein, may be defined as a region of space having a significantly higher impedance to fluid flow, either by itself or together with other contiguous "boundary regions," than does the "bounded region" which it bounds. Thus, for example, the walls, floor, ceiling, door, and windows of a substantially closed room would be "boundary regions" which bound or define the room (i.e., "bounded region"). Moreover, objects or persons in the room are also considered "boundary regions" as they cooperate with the walls, etc., to define the free space of the "bounded region" within the room. During operation there is generally a pressure gradient or a pressure discontinuity or indeterminancy in or at a "boundary region," at an instant in time, whereas pressure within a "bounded region" is relatively uniform at any instant in time. A "boundary region" must offer significant, but not necessarily infinite, impedance to fluid flow, e.g., a narrow passageway serving as a boundary region. In general, some fluid is conducted across a "boundary region" during operation of the system of this invention. However, this does not preclude the existence of a differential pressure across the "boundary region," and may, in fact, actually contribute to the variation in differential pressure, e.g., a duct containing a modulated fan or rotating vane.

Although only preferred embodiments of the invention have been specifically disclosed and described herein, it is to be understood that minor variations may be made therein without departing from the spirit of the invention.

I claim:

1. In an enclosure having at least one boundary region defining at least one bounded region wherein any bounded region has a lower fluidic impedance than any of its boundary regions, a monitoring system for detecting a change in the fluidic impedance of at least one of said boundary regions or for detecting the movement of a portion of at least one of said boundary regions of said enclosure comprising means for inducing a predetermined substantially uniform variation in pressure with respect to time within at least one bounded region of said enclosure, means for monitoring deviation from said predetermined variation, wherein the induced pressure variation is spatially substantially uniform within any said bounded region of said enclosure at most given instants in time during monitoring.

2. The monitoring system of claim 1 wherein said means for monitoring includes means for producing a signal corresponding to the induced variation in pressure within said at least one bounded region, and means for integrating said signal with respect to time.

3. The monitoring system of claim 1 wherein the means for inducing includes means for conducting fluid across a boundary region in a substantially oscillatory manner.

4. The monitoring system of claim 3 wherein the means for conducting includes a port and conduit means for conducting gas across a boundary region, and means adapted to repeatedly block the flow of fluid in said port and conduit means.

5. The monitoring system of claim 3 wherein said means for conducting fluid includes a motor-driven blade mounted for rotation and adapted to alternately block and unblock a port in said conducting means.

6. The monitoring system of claim 3 wherein said fluid conducting means includes a fan.

7. The monitoring system of claim 1 wherein said means for inducing includes means for repeatedly heating fluid.

8. The monitoring system of claim 1 wherein said inducing means includes means for varying pressure in at least two bounded regions.

9. The monitoring system of claim 8, wherein the means for monitoring includes means for monitoring the difference between the varying pressures in said at least two bounded regions.

10. The monitoring system of claim 8, wherein the means for monitoring includes a pressure sensor in at least two of said at least two bounded regions of the enclosure.

11. The monitoring system of claim 10 wherein the means for monitoring further includes means for comparing the pressure variations sensed by at least two of said sensors.

12. The monitoring system of claim 11 wherein the means for comparing includes synchronous detection means.

13. The monitoring system of claim 8 wherein the monitoring means includes means for comparing the induced variations in the at least two bounded regions.

14. The monitoring system of claim 1 wherein said inducing means includes means for varying pressure in at least two bounded regions of the enclosure such that the induced pressure variations in the at least two bounded regions have predetermined relative amplitudes and a common frequency, said means for monitoring including means responsive to a deviation in said relative amplitudes, and means for tuning said monitoring means to said frequency.

15. The monitoring system of claim 14 wherein said means for monitoring includes means for comparing the amplitudes at a predetermined phase.

16. The monitoring system of claim 1 wherein said means for inducing a variation in pressure includes means to modulate the pressure at a predetermined amplitude, said means for monitoring including indicator means responsive to a deviation in said predetermined amplitude.

17. The monitoring system of claim 1 wherein said means for inducing a variation in pressure includes means to modulate the pressure in at least one bounded region at a predetermined frequency and phase, said means for monitoring including indicator means responsive to a deviation in said predetermined phase.

18. The monitoring system of claim 1 wherein said means for inducing a variation in pressure includes means to modulate the pressure at a frequency between about 0.1 Hertz and about 10.0 Hertz.

19. The monitoring system of claim 1 wherein the means for monitoring includes means for tuning to the induced variation in pressure and attenuating spurious signals.

20. The monitoring system of claim 1 wherein said means for monitoring includes sensing means tuned to substantially the frequency and phase of said means for inducing.

21. The monitoring system of claim 1 wherein the means for monitoring includes synchronous detection means for improving operating characteristics of the system.

22. The monitoring system of claim 1 wherein the means for monitoring includes means for correcting the system output for the performance of the means for inducing.

23. The monitoring system of claim 1 wherein said means for monitoring includes means for producing an electrical signal substantially corresponding to the induced variation in the pressure within said at least one bounded region, and filtering and switching means for synchronously rectifying said signal at the frequency of the means for inducing and at a selected phase relative to the means for inducing, so as to attenuate spurious signals and noise at other frequencies and phases.

24. The monitoring system of claim 1 wherein said means for inducing a variation in pressure includes means to vary the pressure at a characteristic frequency which is less than or equal to 10 Hertz.

25. The monitoring system of claim 1 wherein the monitoring means includes means for monitoring the difference in pressure across a boundary region.

26. The monitoring system of claim 25 wherein the means for monitoring includes means for tuning to the variation in said pressure difference and discriminating against spurious signals.

27. The monitoring system of claim 26 wherein the tuning means includes synchronous detection means.

28. The monitoring system of claim 1 wherein the means for monitoring includes at least two pressure transducers.

29. The monitoring system of claim 1 wherein the means for monitoring includes at least two pressure sensors and means for comparing the pressure variations sensed by at least two of the sensors.

30. The monitoring system of claim 1 wherein the means for inducing includes means for inducing substantially inverse pressure variations in two bounded regions on opposite sides of a boundary region.

31. The monitoring system of claim 30 wherein the means for monitoring includes means for monitoring pressure variations in the two bounded regions.

32. The monitoring system of claim 30 wherein the means for monitoring includes means for comparing the induced variations in the two bounded regions.

33. The monitoring system of claim 32 wherein the induced variations have a characteristic frequency, and means for tuning the comparing means to the characteristic frequency.

34. The monitoring system of claim 33 wherein said means for tuning includes synchronous detection means for sharpening said tuning.

35. The monitoring system of claim 30 wherein said means for monitoring includes means for monitoring the difference in pressure across the boundary region.

36. The monitoring system of claim 35 wherein the induced variations have a characteristic frequency, and means for substantially tuning the monitoring means to the characteristic frequency.

37. The monitoring system of claim 36 wherein the means for tuning includes means for synchronous rectification and filtering.

38. The monitoring system of claim 36 wherein the means for monitoring further includes means for averaging the deviation over a number of cycles.

39. The monitoring system of claim 38 wherein the means for monitoring further includes alarm means responsive to the averaged deviation.

40. The monitoring system of claim 35 wherein the induced variations have a primary frequency component which is at least 0.1 Hertz and no greater than 10.0 Hertz.

41. The monitoring system of claim 30 wherein the means for inducing includes a fan means.

42. The monitoring system of claim 41 wherein the means for inducing includes means for conducting fluid between the two bounded regions in a substantially oscillatory manner.

43. The monitoring system of claim 1 wherein the induced variation is substantially periodic, the periodic variation having a given fundamental frequency, and wherein the means for monitoring is tuned to the fundamental frequency.

44. The monitoring system of claim 43 wherein the means for monitoring includes synchronous rectification means.

45. In an enclosure having at least one boundary region defining at least one bounded region wherein said boundary regions provide significant impedance to fluid flow and are capable of supporting a significant differential pressure thereacross, a monitoring system for detecting a change in the fluidic impedance of at least one of said boundary regions or for detecting the movement of at least a portion of a boundary region, comprising means for inducing, with respect to time, a predetermined substantially uniform variation in the differential pressure across at least one boundary region of said enclosure, means for monitoring deviation from said predetermined variation, wherein the instantaneous induced pressure variation is spatially substantially uniform within any said bounded region of said enclosure at substantially any given instant in time during monitoring.

46. The monitoring system of claim 45 wherein the means for inducing includes fluid temperature modification means, and means for varying fluid flow in heat transfer relationship with said fluid temperature modification means.

47. The monitoring system of claim 45 wherein the means for monitoring includes alarm means responsive to said deviation from said predetermined variation.

48. The monitoring system of claim 45 wherein the means for inducing includes a thermally powered device.

49. The monitoring system of claim 45 wherein the induced variation has a characteristic frequency, and wherein the monitoring means includes means responsive to a change in the phase of the induced variation in pressure in a bounded region relative to the phase of the means for inducing.

50. The monitoring system of claim 45 wherein the induced variation has a characteristic frequency, and wherein the monitoring means includes means for monitoring the induced variation at a selected phase relative to the means for inducing.

51. The monitoring system of claim 45 wherein the monitoring means includes means for generating a signal indicative of the induced variation and means for synchronously rectifying the signal.

52. The monitoring system of claim 51 wherein the monitoring means further includes means for averaging the signal.

53. The monitoring system of claim 45 wherein the induced variation is substantially periodic, and means for tuning the monitoring means to the frequency of the variation.

54. The monitoring system of claim 53 wherein the tuning means includes means for synchronous rectification and filtering.

55. The monitoring system of claim 53 wherein the means for inducing includes fan means for producing a flow of the fluid.

56. The monitoring system of claim 53 wherein the characteristic frequency of the induced variation is at least 0.1 Hertz and no greater than 10.0 Hertz.

57. The monitoring system of claim 45 wherein the means for inducing includes a fan means for producing a flow of the fluid.

58. The monitoring system of claim 45 wherein said means for inducing a variation in the differential pressure includes means to vary the differential pressure at a characteristic frequency which is less than 10.0 Hertz.

59. The monitoring system of claim 45 wherein the induced variation has a fundamental frequency between 0.1 Hertz and 10.0 Hertz.

60. The monitoring system of claim 45 wherein the means for monitoring includes at least two pressure transducers.

61. The monitoring system of claim 60 wherein the means for monitoring includes means for comparing the output signals of at least two of the transducers.

62. The monitoring system of claim 54 wherein said means for inducing includes means for making said pressure variation substantially cyclical, and wherein the means for monitoring includes synchronous detection means.

63. The monitoring system of claim 45 including means for substantially tuning the monitoring means to the variation.

64. The monitoring system of claim 54 wherein the induced variation has a characteristic frequency, and further including means for tuning the monitoring means to the characteristic frequency.

65. The monitoring system of claim 45 wherein the induced variation has a predetermined amplitude and frequency, and wherein the monitoring means includes means tuned to said frequency and responsive to a deviation in said amplitude.

66. The monitoring system of claim 65 wherein the monitoring means includes means for synchronous rectification and filtering.

67. The monitoring system of claim 45 wherein the means for inducing includes means for producing a differential pressure of substantially constant amplitude and frequency.

68. The monitoring system of claim 45 wherein the inducing means includes means for inducing substantially inverse pressure variations on opposite sides of a boundary region.

* * * * *